US008887681B2

(12) United States Patent
Wiesner et al.

(10) Patent No.: US 8,887,681 B2
(45) Date of Patent: Nov. 18, 2014

(54) CAM UNIT FOR A CONSTRUCTED CAMSHAFT

(75) Inventors: Peter Wiesner, Mauren (LI); Manfred Muster, Ludesch (AT); Thomas Binder, Feldkirch (AT); Jonathan Heywood, Chemnitz (DE)

(73) Assignee: ThyssenKrupp Presta TecCenter AG, Eschen (LI)

( * ) Notice: Subject to any disclaimer, the term of this patent is extended or adjusted under 35 U.S.C. 154(b) by 0 days.

(21) Appl. No.: 13/516,529

(22) PCT Filed: Nov. 11, 2010

(86) PCT No.: PCT/EP2010/006885

§ 371 (c)(1),
(2), (4) Date: Sep. 21, 2012

(87) PCT Pub. No.: WO2011/072782

PCT Pub. Date: Jun. 23, 2011

(65) Prior Publication Data

US 2013/0000442 A1 Jan. 3, 2013

(30) Foreign Application Priority Data

Dec. 18, 2009 (DE) ..... 10 2009 059 712

(51) Int. Cl.
*F01L 1/04* (2006.01)
*F01L 13/00* (2006.01)

(52) U.S. Cl.
CPC ..... *F01L 13/0036* (2013.01); *F01L 2013/0052* (2013.01)
USPC ..... 123/90.6; 29/888.1; 384/24

(58) Field of Classification Search
CPC ..... F01L 1/047; F01L 1/053; F01L 1/08; F01L 2001/0473
USPC ..... 123/90.6; 29/888.1; 384/24
See application file for complete search history.

(56) References Cited

U.S. PATENT DOCUMENTS

| | | | | |
|---|---|---|---|---|
| 5,826,461 | A * | 10/1998 | Kaywood et al. | 74/567 |
| 7,409,938 | B2 * | 8/2008 | Dengler | 123/90.18 |
| 8,161,930 | B2 * | 4/2012 | Elendt et al. | 123/90.6 |
| 2007/0034184 | A1 | 2/2007 | Dengler | |
| 2008/0060594 | A1 | 3/2008 | Cline et al. | |

FOREIGN PATENT DOCUMENTS

| | | | |
|---|---|---|---|
| DE | 195 20 117 | A1 | 12/1996 |
| DE | 10 2004 011 586 | A1 | 10/2004 |
| DE | 102004022849 | A1 * | 12/2005 |
| DE | 10 2007 043 169 | A1 | 4/2008 |

(Continued)

OTHER PUBLICATIONS

Cline et al., Engine Tubular Camshaft Assembly with Multi-Lift Cam Sets and Method, US Patent application Pub. No. US2008/0060594, Mar. 13, 2008.*

(Continued)

*Primary Examiner* — Ching Chang
(74) *Attorney, Agent, or Firm* — Crowell & Moring LLP

(57) ABSTRACT

A cam unit for arranging on a camshaft main part of a camshaft in a rotationally fixed and axially movable manner. The cam unit includes a tubular sleeve main part and at least one cam element that lies on the sleeve main part in a rotationally fixed and non-movable manner. The sleeve main part and the at least one cam element are designed as individual parts that can be separately produced and subsequently assembled.

9 Claims, 3 Drawing Sheets

(56) References Cited

FOREIGN PATENT DOCUMENTS

Figure 1:
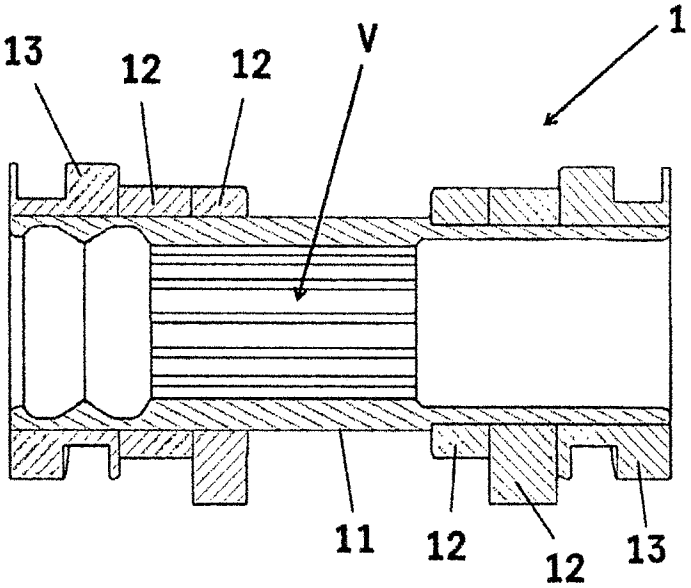

| | | | |
|---|---|---|---|
| DE | 10 2007 016 977 | A1 | 10/2008 |
| DE | 10 2008 024 876 | A1 | 11/2009 |
| DE | 10 2009 022 657 | A1 | 1/2011 |
| EP | 1 936 130 | A2 | 6/2008 |

OTHER PUBLICATIONS

International Search Report including English language translation dated Feb. 4, 2011 (Four (4) pages).
German-language Office Action dated Dec. 2, 2013 (seven (7) pages).

* cited by examiner

CAM UNIT FOR A CONSTRUCTED CAMSHAFT

BACKGROUND AND SUMMARY OF THE INVENTION

Exemplary embodiments of the present invention relate to a (built-up) cam unit for the rotationally-fixed and axially displaceable arrangement on a main camshaft body of a camshaft (which is built-up or is to be built-up). Moreover, exemplary embodiments of the present invention encompass a camshaft having a main camshaft body and a cam unit disposed on the main camshaft body in a rotationally-fixed and axially displaceable manner, in accordance with the main claim. Furthermore, exemplary embodiments of the present invention encompass a camshaft module which supports, in an at least partially peripherally closed bearing device, a built-up camshaft having a drivable main camshaft body and at least one cam unit mounted on the main camshaft body in an axially displaceable and rotationally-fixed manner, in accordance with the main claim.

German Patent Document DE 10 2004 011 586 A1 discloses a valve train for an internal combustion engine, which comprises at least one camshaft on which at least one cam carrier is disposed in a rotationally-fixed and axially displaceable manner. Formed between the camshaft and the at least one cam carrier are means for applying an axial clamping force which is used to fix the at least one cam carrier axially in the bearing receptacle. The proposed cam carrier comprises at least one cam, on which at least two different cam tracks are formed, and is surrounded for bearing purposes by a camshaft bearing fixed to the cylinder head. The proposed cam carrier consists substantially of a total of three components: an axial main body including integrated cams on both sides and a track profile pressed in each case on the two free ends of the main body.

Exemplary embodiments of the present invention are directed to a cam unit (hereinafter also referred to as a built-up cam unit), whereby on the one hand the cam unit, and in corresponding developments also a (built-up) camshaft supporting such a (built-up) cam unit as well as a corresponding camshaft module comprising such a (built-up) camshaft are to be optimized in terms of manufacturing costs and functional requirements placed on such a (built-up) cam unit.

According to exemplary embodiments of the present invention, a cam unit is further divided into individual, prefabricated individual components such that these individual components can be manufactured in a simplified manner and can be designed optimally in terms of their technical requirements, in particular through different material properties. Furthermore, the modular design of such a "built-up" cam unit for a "built-up" camshaft should simplify the assembly of a camshaft module with such an assembled (built-up) camshaft in terms of the installation of the camshaft in the at least partially peripherally closed bearing receptacle (e.g., bearing block or bearing/ladder frame or the like) of the camshaft module.

In accordance with exemplary embodiments of the present invention, a cam unit (in terms of a so-called "switchable cam" having at least two different cam track profiles allocated to a common cam follower) for the arrangement on a main camshaft body of a built-up camshaft in a rotationally-fixed and axially displaceable manner comprises at least one main tubular sleeve body and at least one cam element disposed on the main sleeve body in a rotationally-fixed and non-displaceable manner. In accordance with the invention, the sleeve body and the at least one cam element are formed as separately produced individual parts. The cam element is advantageously formed of multiple parts and comprises at least two individual disk elements that are disposed axially adjacent to each other, are allocated to a common cam follower and have different cam track profiles (peripheral profiles). Alternatively, the cam element can be formed in one piece, wherein it is contoured on the periphery such that several cam track profiles are formed axially next to each other. In the following description, a cam element is understood to mean a one-piece cam element having several cam track profiles and also each individual disk body of a cam element in multiple parts is designated as a cam element. In one aspect of the invention, a separately produced track element is connected to the main sleeve body of the cam unit. This ensures in a simple manner that the individual components, such as main sleeve body, cam element(s) and track elements, can be produced from different materials or different material compositions of the same material. Furthermore, the properties of the individual components can also be individually improved by way of further, separate processing thereof and these components can be individually adapted and optimized in terms of their respective function. For example, a main sleeve body produced from simple structural steel (e.g., St52-3, 40MnB5, 26MnB5, C60, CF53 or the like) can support a cam element produced from a forged, special and (e.g., inductively) hardened steel or a cam element consisting of a sintered metal. A track element to be connected to the main sleeve body can also be produced from a steel which has been correspondingly further processed (e.g., nitrided) or from a sintered metal and can be connected to the main sleeve body consisting of another steel (or consisting of another material or of another material composition).

In order to correspondingly reduce the manufacturing costs, the separately produced track elements and the main sleeve body (-ies) provided with an inner toothed arrangement are produced from a conventional structural steel. The cam elements are preferably formed to be forged in accordance with a standard production process for built-up camshafts. In order to be able to optimally satisfy the functional requirements placed upon the individual components, the track elements are advantageously formed to be (inductively) hardened and in particular nitrided, whereas the forged cams can be hardened, in particular inductively or in another manner, in a further processing step. The connection between the individually separately produced components to be assembled to form a cam unit can be effected via a press-fit connection, a positive-locking connection, a solder, adhesive or weld connection or any combination of said connection possibilities.

The invention further encompasses a built-up camshaft having a main camshaft body (which can be formed as a whole or in sections to be soft, hardened and/or nitrided) and a cam unit disposed on the main camshaft body in a rotationally-fixed and axially displaceable manner (and also can be formed as a whole or in sections to be soft, hardened and/or nitrided) as was constructed or produced in accordance with preceding embodiments.

Exemplary embodiments of the present invention further involve a camshaft module having a bearing device with bearing receptacles for rotatably bearing the built-up camshaft, wherein the built-up camshaft is of the previously described type.

In the particularly preferred embodiment of the camshaft module, the assembly and bearing of a built-up camshaft are provided in closed bearing blocks or in a so-called closed bearing tunnel. In terms of the invention, such a closed bearing tunnel is understood to mean a bearing receptacle/bearing that is formed to be partially or completely peripherally closed such that assembly of the main camshaft body or the camshaft is only possible by laterally sliding-in the main camshaft body. It is not possible to insert the camshaft transversely to the rotational axis thereof into a corresponding bearing receptacle in the case of such bearing receptacles. Assembling built-up camshafts in a one-piece bearing block or in a one-piece ladder frame or in a closed bearing of a cylinder head cover (monolithic cylinder head cover) or the like is generally extremely problematic owing to the narrow constructional space and the assembly process that is complicated as a result. Conventionally, this problem has generally been avoided by forming the ladder frame or its bearing receptacles as separate components in multiple parts for a so-called "open bearing receptacle" (into which a camshaft can be inserted transversely to the bearing/rotational axis). In other conventional arrangements, the inner diameter of the cam shaft bearing has been extended such that the camshaft could be assembled axially (slid-in laterally) in one piece including the cams and functional elements disposed thereon (so-called tunnel bearing). In the former case, increased production and assembly outlay is generally unavoidable. In the latter case, the increase in the bearing diameter results in increased friction in the valve train and a negative effect, associated therewith, with respect to the required constructional space.

In the camshaft module according to exemplary embodiments of the present invention, the main sleeve body of the cam unit is characterised in that starting from one of the two free ends of the main sleeve body, the outer diameter of the main sleeve body is adapted at least in regions to the inner diameter of the bearing device such that the main sleeve body can be laterally slid into the closed bearing receptacle. In one aspect of the camshaft module of the present invention, the outer diameter of the cam unit is adapted at least in regions to the inner diameter of the bearing device such that a sliding bearing is created between the main sleeve body and the bearing receptacle.

BRIEF DESCRIPTION OF THE DRAWING FIGURES

The invention will be illustrated and explained in more detail hereinafter for a preferred exemplified embodiment with the aid of Figures in the drawing, in which:

FIG. 1 shows a cam unit in accordance with the present invention in a possible first embodiment, and FIGS. 2*a*-2*d* show individual assembly steps of a cam unit in accordance with the invention in a bearing receptacle, which is at least partially peripherally closed or is completely peripherally closed, of an internal combustion engine.

DETAILED DESCRIPTION

FIG. 1 shows a cam unit 1 having a main tubular sleeve body 11 that supports, on each of its two free ends (at the ends), a track element 13 and also on both sides two individual disk elements (hereinafter also referred to as cam elements 12) adjacent to each other towards the inner sides. The main sleeve body 11 and also the individual cam elements 12 and the track elements 13 on both sides are produced as individual separate components. The individual components are assembled together during different assembly ste to form a cam unit in accordance with the invention (which is also referred to as a so-called "switchable cam" with different cam tracks). In the completely assembled cam unit 1, the individual components, such as the main sleeve body 11, cam element 12 and track element 13, are connected together such that a rotationally-fixed and non-displaceable connection is formed between the main sleeve body 11 and the components 12, 13 to be attached thereto. The different cam elements 11 disposed on each free end or allocated thereto have different cam tracks or track profiles. Therefore, in the illustrated exemplified embodiment, the cam element 12 disposed axially on the left on the main sleeve body 11 is formed e.g., as a cam element 12 for the cylinder cut-off with a (zero) stroke remaining constant on the periphery and corresponding to the main circular diameter, whereas the cam element 12 disposed axially next to it on the right has a correspondingly formed stroke for the controlled, temporary opening of gas-exchange valves of an internal combustion engine. For the axial displacement of the cam unit 1 on a main camshaft body 2 of a built-up camshaft, the main sleeve body 11 and the main camshaft body 2 can have profiles (in particular multi-tooth profiles) that correspond to each other accordingly at least in regions, which ensures a rotationally-fixed and axially displaceable bearing of the cam unit on the main camshaft body 2 In order to be able to axially displace the cam unit 1 on the main camshaft body 2, the track elements 13 disposed on both sides on the main sleeve body 11 co-operate with pin elements, not illustrated, disposed radially with respect to the main sleeve body 11 (and disposed in a positionally-fixed manner in the internal combustion engine) which leans that when such a pin element engages with a track of a corresponding track element 13, the cam unit 1 can be displaced on the main camshaft body 2 in the corresponding axial direction. Only a limited number of functional elements can be disposed on both sides on the main sleeve body 11 which means that in the central region of the main sleeve body 11 this is disposed or can be disposed in an axially displaceable manner in a bearing receptacle LA attached to the side of the internal combustion engine. For the axial positioning of the cam unit 1, the main sleeve body 11 comprises on its inner surface teeth or grooves, preferably extending on the periphery, for the engagement of a ball element mounted in the main camshaft body 2 in the radial direction against a spring force. In this manner, the cam unit 1 can be temporarily fixed, in a manner that can be overcome by a force acting axially on the cam unit, in different axial positions in which the cam unit 1 in each case co-operates either with its left cam element 12 or with its right cam element 12 disposed next to it on the right in the axial direction having a corresponding cam follower (not illustrated) for actuating gas-exchange valves which are to be actuated on the inlet-side or outlet-side.

FIGS. 2*a*-2*d* illustrate the assembly of the cam unit 1 in accordance with the invention in a bearing receptacle that is partially peripherally closed or completely peripherally closed for the bearing of the built-up camshaft. In accordance with FIG. 2*a*, a first embodiment of a cam unit 1 is preassembled from individually prefabricated components and is provided for assembly in a peripherally closed bearing receptacle LA. The cam unit 1 illustrated in FIG. 2*a* can, in one embodiment, represent an already completely assembled cam unit 1 to be slid into the bearing receptacle LA. In the assembly process set out below for the bearing of a camshaft that can be slid into a closed bearing receptacle LA axially on the side, the illustrated cam unit 1 is merely a preassembled semi-finished part. The cam unit 1 comprises on its main sleeve body 11 on the left-hand side on its free end a track element 13 and two individual cam elements 12 having different cam track profiles disposed next to it on the right. The individual functional elements 12, 13 are disposed on the main sleeve body 11 in a non-positive-locking or non-positive/positive-locking manner.

Figure 2A:
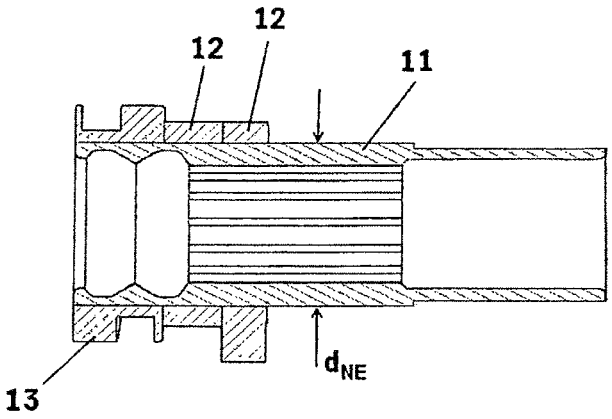
Figure 2B:
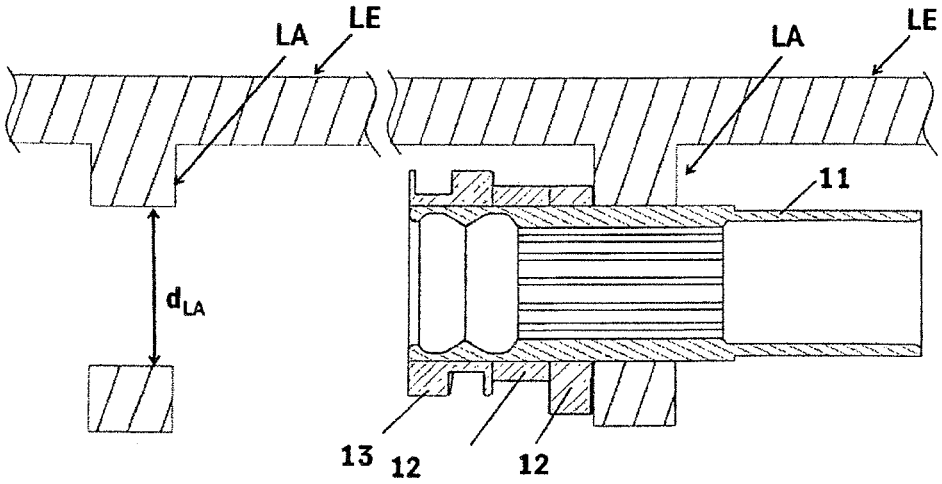
Figure 2C:
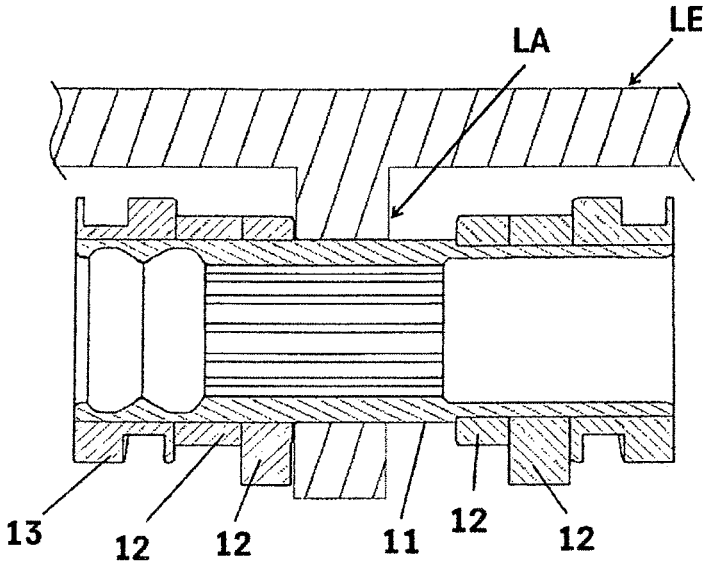

In a further assembly step in accordance with FIG. 2*b*, the preassembled semi-finished part is slid laterally into a peripherally closed bearing receptacle LA. For this purpose, the main sleeve body 11 of the cam unit 1 has at least in regions an outer diameter $d_{NE}$ and the bearing receptacle LA has an inner diameter $d_{LA}$ adapted thereto that the main sleeve body 11 (and advantageously a sliding bearing between the two parts) can be slid laterally into the bearing receptacle LA.

In a subsequent assembly step (FIG. 2*c*), the laterally slid-in cam unit 1 is provided with corresponding functional elements 12, 13 on its free end in particular in a mirror-symmetrical manner with respect to the already preassembled side.

Figure 2D:
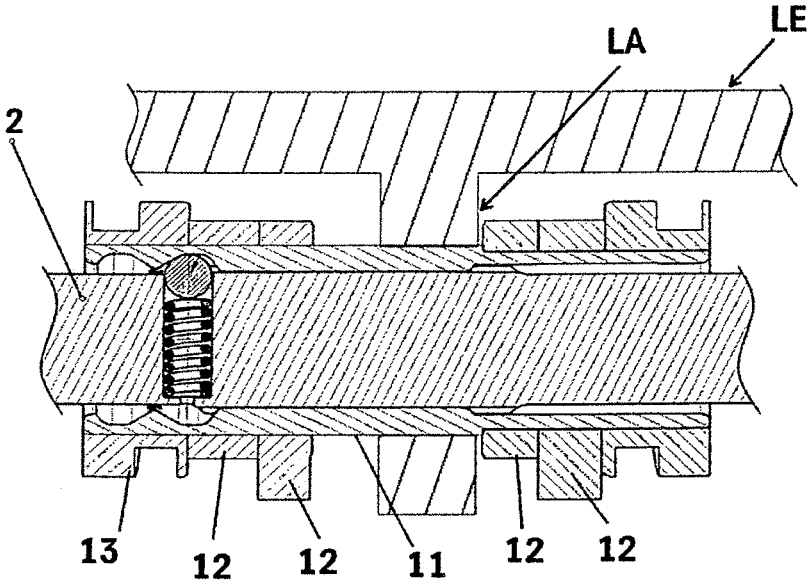

Finally, in FIG. 2*d*, the completely assembled cam module is illustrated in sections using the example of a completely assembled bearing point LA. The main camshaft body 2 is already slid into the preassembled main sleeve body 11 axially on the side and is disposed with its ball spring element—acting in the radial direction—axially fixed in a corresponding annular inner groove of the main sleeve body 11. The described assembly process for the assembly of a cam unit 1 in accordance with the invention in a closed bearing receptacle LA can accordingly be repeated as required for other bearing points LA. In this case, the main camshaft body 2 is slid-in in accordance with FIG. 2*d* only after the assembly of a further cam unit 1 in a corresponding bearing receptacle LA.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A camshaft module, comprising:

a bearing device having at least one bearing receptacle for rotatable bearing of a built-up camshaft; and a built-up camshaft comprising a drivable main camshaft body; and a cam unit comprising a main tubular sleeve body; and at least one cam element disposed on the main tubular sleeve body in a rotationally-fixed and non-displaceable manner, wherein the main tubular sleeve body and the at least one cam element are separately produced and subsequently assembled individual parts, and wherein the main tubular sleeve body of the at least one cam unit for the bearing of the camshaft is encompassed by the at least one bearing receptacle, wherein the main tubular sleeve body and the at least one cam element consist of different materials or different compositions of the same materials, wherein the bearing receptacle is formed as bearing receptacle that is partially peripherally closed or completely peripherally closed, such that the drivable main camshaft body of the built-up camshaft can only be assembled by axial, lateral sliding of the drivable main camshaft body into the bearing receptacle.

2. The camshaft module as claimed in claim 1, wherein at least sections of an outer diameter of the main tubular sleeve body of the cam unit are adapted to an inner diameter of the bearing receptacle such that the main tubular sleeve body can slide laterally into the bearing receptacle.

3. The camshaft module as claimed in claim 2, wherein at least sections of the outer diameter of the main tubular sleeve body of the cam unit are adapted to the inner diameter of the bearing receptacle such that a sliding bearing is produced between the main tubular sleeve body and the bearing receptacle.

4. A method of assembling a camshaft module, the method comprising:

partially assembling a cam unit by disposing at least one first cam element on a first side of a main tubular sleeve body in a rotationally-fixed and non-displaceable manner, wherein the main tubular sleeve body includes a second side arranged laterally opposite of the first side;

axially, laterally sliding the partially assembled cam unit into a bearing receptacle by sliding the second side of the main tubular sleeve body into the bearing receptacle; and completing assembly of the cam unit by disposing at least one second cam element on the second side of the main tubular sleeve body in a rotationally-fixed and non-displaceable manner after the partially assembled cam unit is inserted into the bearing receptacle, and by inserting a drive main camshaft body into the main tubular sleeve body, wherein the main tubular sleeve body and the at least one first cam element and the at least one second cam element are separately produced, wherein the bearing receptacle is formed as bearing receptacle that is partially peripherally closed or completely peripherally closed such that the drivable main camshaft body can only be assembled by the axial, lateral sliding of the drivable main camshaft body into the bearing receptacle.

5. The method of claim 4, wherein the at least one first cam element and the at least one second cam element are disposed on the main tubular sleeve body in a mirror-symmetric manner.

6. The method of claim 4, wherein the partial assembly of the cam unit comprises disposing a first track element on a side of the at least one first cam element that is opposite of a side of the at least one first cam element facing the second side of the main tubular sleeve body.

7. The method of claim 6, wherein the completion of assembly of the cam unit comprises disposing a second track element on a side of the at least one second cam element that is opposite of a side of the at least one second element facing the first side of the main tubular sleeve body.

8. The method of claim 4, wherein at least sections of an outer diameter of the main tubular sleeve body of the cam unit are adapted to an inner diameter of the bearing receptacle such that the main tubular sleeve body slides laterally into the bearing receptacle.

9. The method of claim 8, wherein at least sections of the outer diameter of the main tubular sleeve body of the cam unit are adapted to the inner diameter of the bearing receptacle such that a sliding bearing is produced between the main tubular sleeve body and the bearing receptacle.

* * * * *